US009938694B2

(12) United States Patent
Matsuyama et al.

(10) Patent No.: US 9,938,694 B2
(45) Date of Patent: Apr. 10, 2018

(54) CONTROL DEVICE FOR WORK MACHINE, WORK MACHINE, AND METHOD OF CONTROLLING WORK MACHINE

(71) Applicant: Komatsu Ltd., Tokyo (JP)

(72) Inventors: Toru Matsuyama, Naka-gun (JP); Yuki Shimano, Suita (JP); Masashi Ichihara, Hiratsuka (JP); Yoshiki Kami, Hadano (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 15/301,779

(22) PCT Filed: Mar. 29, 2016

(86) PCT No.: PCT/JP2016/060271

§ 371 (c)(1),
(2) Date: Oct. 4, 2016

(87) PCT Pub. No.: WO2016/129708

PCT Pub. Date: Aug. 18, 2016

(65) Prior Publication Data

US 2017/0284070 A1 Oct. 5, 2017

(51) Int. Cl.
*E02F 9/26* (2006.01)
*E02F 3/32* (2006.01)
(Continued)

(52) U.S. Cl.
CPC ..... *E02F 9/265* (2013.01); *E02F 3/32* (2013.01); *E02F 3/435* (2013.01); *E02F 9/20* (2013.01);
(Continued)

(58) Field of Classification Search
CPC ... E02F 9/265; E02F 3/435; E02F 3/32; E02F 9/20; E02F 9/2033; E02F 9/22
(Continued)

(56) References Cited

U.S. PATENT DOCUMENTS 5,446,980 A * 9/1995 Rocke ..... E02F 3/439 37/348
5,682,312 A * 10/1997 Rocke ..... E02F 3/437 37/414
(Continued)

FOREIGN PATENT DOCUMENTS

JP 06-146332 A 5/1994
JP 2001-123476 A 5/2001
(Continued)

OTHER PUBLICATIONS

International Search Report dated Jun. 21, 2016, issued for PCT/JP2016/060271.

*Primary Examiner* — Tyler J Lee
(74) *Attorney, Agent, or Firm* — Locke Lord LLP

(57) ABSTRACT

A control device for a work machine is a device for controlling a working unit of a work machine to excavate an object to be excavated. The control device includes a control unit for controlling the working unit to prevent a working implement of the working unit from crossing a predetermined target profile, and a switching unit for defining the target profile as an offset profile separated by a predetermined distance from a target excavation profile that is a target profile for finishing of the object to be excavated or the target excavation profile, based on an attitude of the working implement relative to the target excavation profile.

10 Claims, 11 Drawing Sheets

(51) Int. Cl.
*E02F 3/43* (2006.01)
*E02F 9/20* (2006.01)
*E02F 9/22* (2006.01)

(52) U.S. Cl.
CPC ..... *E02F 9/2033* (2013.01); *E02F 9/2292* (2013.01); *E02F 9/2296* (2013.01); *E02F 9/262* (2013.01); *E02F 9/22* (2013.01)

(58) Field of Classification Search
USPC ..... 701/50
See application file for complete search history.

(56) References Cited

U.S. PATENT DOCUMENTS 5,735,065 A * 4/1998 Yamagata ..... E02F 3/437 37/348
5,799,419 A * 9/1998 Seo ..... B25J 9/1679 37/348
5,918,527 A * 7/1999 Haga ..... E02F 3/437 172/4.5
5,968,104 A * 10/1999 Egawa ..... E02F 3/435 37/414
6,131,061 A * 10/2000 DenBraber ..... E02F 3/435 37/348
6,169,948 B1 * 1/2001 Fujishima ..... E02F 3/435 172/4.5
7,007,415 B2 * 3/2006 Koch ..... E02F 3/437 37/348
9,194,106 B2 * 11/2015 Matsuyama ..... E02F 3/437
9,410,305 B2 * 8/2016 Matsuyama ..... E02F 3/435
9,458,598 B2 * 10/2016 Takaura ..... E02F 3/437
2005/0132618 A1 6/2005 Koch
2013/0302124 A1 * 11/2013 Matsuyama ..... E02F 3/435 414/687
2013/0315699 A1 * 11/2013 Matsuyama ..... E02F 3/435 414/687
2014/0142817 A1 5/2014 Matsuyama
2014/0200776 A1 * 7/2014 Matsuyama ..... E02F 3/435 701/50

FOREIGN PATENT DOCUMENTS

JP 2005-180170 A 7/2005
JP 2007-085093 A 4/2007
JP 2014-224452 A 12/2014
WO 2012/127912 A1 9/2012

* cited by examiner

CONTROL DEVICE FOR WORK MACHINE, WORK MACHINE, AND METHOD OF CONTROLLING WORK MACHINE

FIELD

The present invention relates to a control device for a work machine configured to control a work machine including a working unit, a work machine, and a method of controlling a work machine.

BACKGROUND

There is description of a construction machine including a working unit in which when the type of operation is determined as shaping operation, a bucket is moved along a designed surface indicating a target profile of an object to be excavated, and when the type of operation is determined as tooth tip positioning operation, the bucket is stopped at a predetermined position relative to the designed surface (e.g., see Patent Literature 1).

CITATION LIST

Patent Literature

Patent Literature 1: WO 2012/127912 A1

SUMMARY

Technical Problem

When a slope is formed, the bucket is considered to be moved to form the slope as a target profile. When the slope is formed, two operation processes are required, that is, excavating the object and compacting the dug surface. In this case, it is considered that the object is excavated to have a compaction allowance, and then the bucket is pressed to a target position of the slope by the compaction allowance. When the working unit is controlled not to cross a target profile for finishing the object to be excavated, the target profile for finishing is considered to have a target profile for the excavation including the compaction allowance, and the target profile of the slope. In such a situation, the work machine operator needs to set a plurality of target profiles for finishing, and operation is complicated.

It is an object of an aspect of the present invention to provide a work machine with which complicated operation of a work machine operator is reduced while forming a slope.

Solution to Problem

According to a first aspect of the present invention, a control device for a work machine, the control device being configured to control a working unit of the work machine to excavate an object to be excavated, the control device comprises: a control unit configured to control the working unit to prevent a working implement of the working unit from crossing a predetermined target profile; and a switching unit configured to define the target profile as an offset profile separated by a predetermined distance from a target excavation profile that is a target profile for finishing of the object to be excavated or the target excavation profile, based on an attitude of the working implement relative to the target excavation profile.

According to a second aspect of the present invention, a work machine comprises the control device for a work machine according to the first aspect.

According to a third aspect of the present invention, a method of controlling a work machine, the method controlling a working unit of the work machine to excavate an object to be excavated, the method comprises: defining a predetermined target profile as an offset profile separated by a predetermined distance from a target excavation profile that is a target profile for finishing of the object to be excavated or the target excavation profile, based on an attitude of the working implement relative to the target excavation profile; and controlling the working unit not to cross the target profile while the working unit excavates the object to be excavated.

According to an aspect of the present invention, a work machine can reduce complicated work of a work machine operator, when forming a slope.

DESCRIPTION OF EMBODIMENTS

A best mode for carrying out the present invention (embodiment) will be described below in detail with reference to the drawings.

<Overall Configuration of Work Machine>

Figure 1:
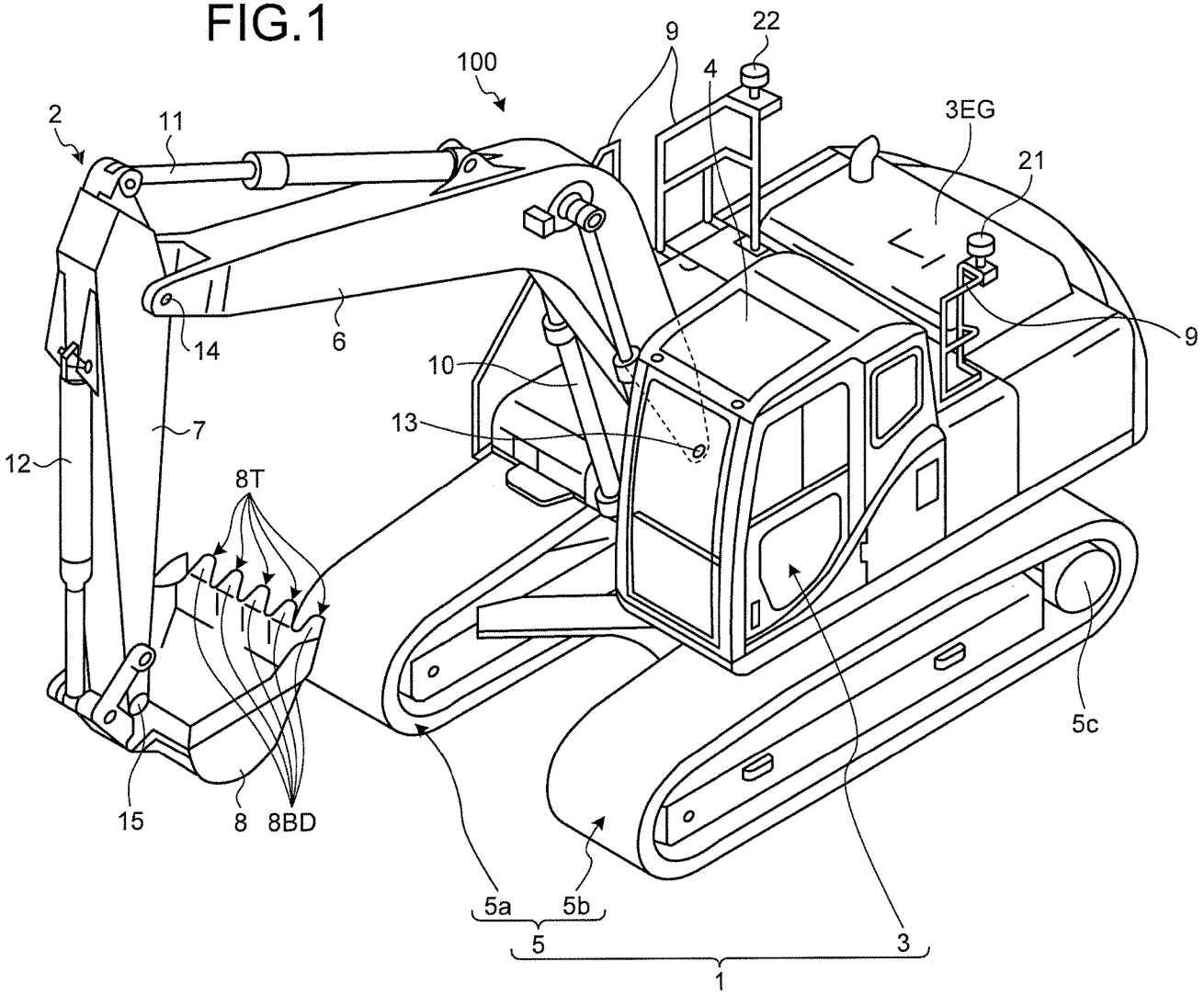
FIG. 1 is a perspective view of a work machine according to an embodiment.
Figure 2:
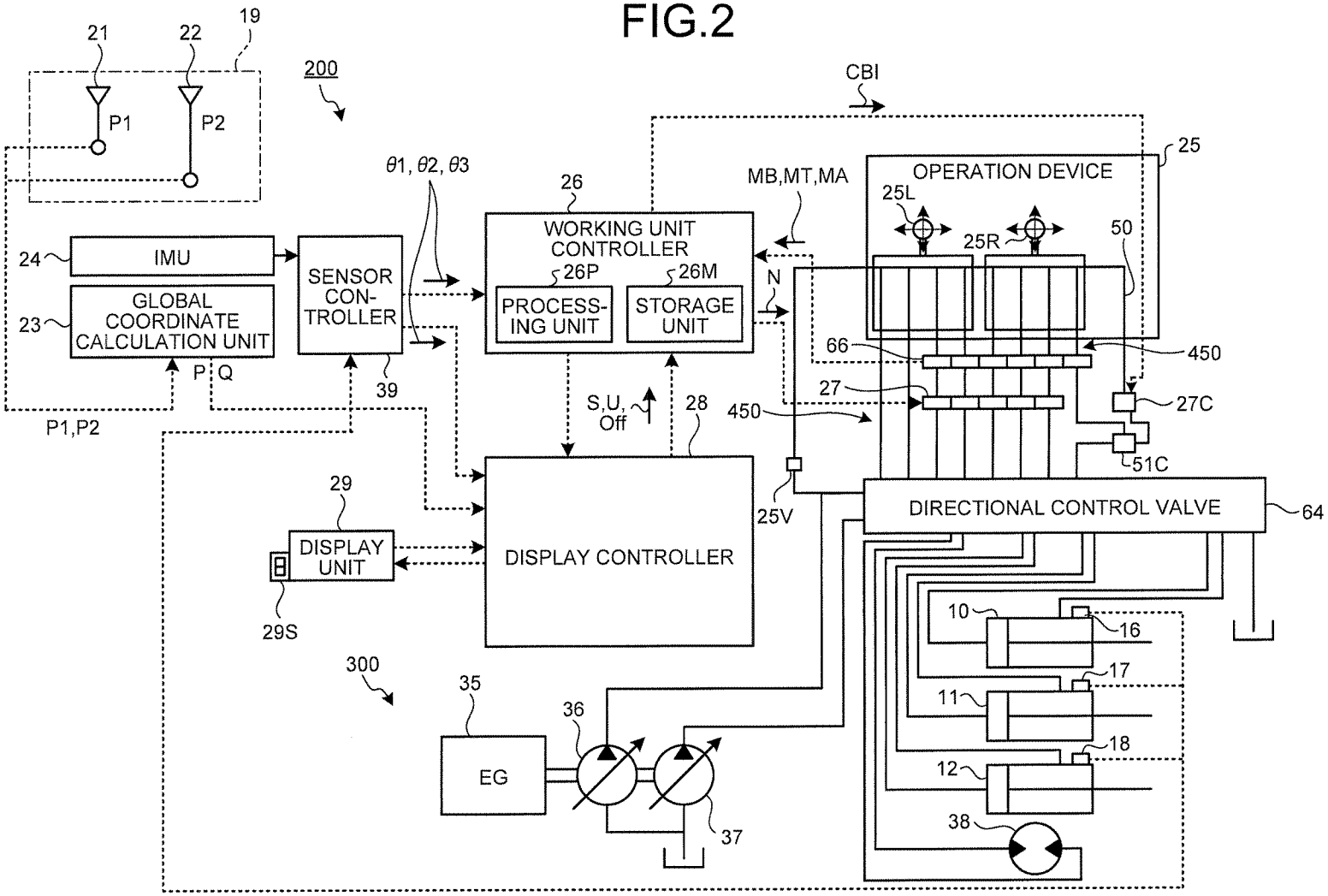
FIG. 2 is a block diagram illustrating a configuration of a control system and a hydraulic system of an excavator.

FIG. 1 is a perspective view of a work machine according to an embodiment. FIG. 2 is a block diagram illustrating a configuration of a control system 200 and a hydraulic system 300 of an excavator 100. The excavator 100 being the work machine has a vehicle body 1 and a working unit 2. The vehicle body 1 has an upper swing body 3 as a swing body and a travel unit 5 as a travel body. The upper swing body 3 has an engine room 3EG internally housing an internal combustion engine as a power generation device and a device such as a hydraulic pump. In the embodiment, for the internal combustion engine as the power generation device, the excavator 100 uses for example a diesel engine, but the power generation device is not limited to such a configuration.

The upper swing body 3 includes a cab 4. The upper swing body 3 is mounted on the travel unit 5. The travel unit 5 includes track belts 5*a* and 5*b*. The travel unit 5 has travel motors 5*c* provided on the right and left sides of the travel unit 5, and one or both of the travel motors 5*c* rotatably drive the track belts 5*a* and 5*b* to cause the excavator 100 to travel.

The upper swing body 3 has a front side on which the working unit 2 and the cab 4 are disposed, and a back side on which the engine room 3EG is disposed. The left side toward the front side corresponds to the left side of the upper swing body 3, and the right side toward the front side corresponds to the right side of the upper swing body 3. The right and left direction of the upper swing body 3 is also referred to as a width direction. In the excavator 100 or the vehicle body 1, the travel unit 5 is positioned below the upper swing body 3, and the upper swing body 3 is positioned above the travel unit 5. When the excavator 100 is positioned on a horizontal plane, a lower side represents a vertical direction, that is, a gravity acting direction, and an upper side represents a direction opposite to the vertical direction.

The working unit 2 includes a boom 6, an arm 7, a bucket 8 as a working implement, a boom cylinder 10, an arm cylinder 11, and a bucket cylinder 12. The boom 6 has a base end portion mounted to a front portion of the vehicle body 1 through a boom pin 13. The arm 7 has a base end portion mounted to an end portion of the boom 6 through an arm pin 14. The arm 7 has an end portion to which the bucket 8 is mounted through a bucket pin 15. The bucket 8 moves around the bucket pin 15. The bucket 8 has a plurality of teeth 8BD mounted on a side opposite to the bucket pin 15. Each of the teeth 8BD has a tooth tip 8T at an end thereof.

In the embodiment, lifting of the working unit 2 represents operation of moving the working unit 2 from a contact area of the excavator 100 to the upper swing body 3 thereof. Lowering of the working unit 2 represents operation of moving the working unit 2 from the upper swing body 3 of the excavator 100 to a contact area thereof. The excavator 100 has the contact area being a plane defined by at least three points in a portion making contact with the ground of each of the track belts 5*a* and 5*b*. The at least three points used for definition of the contact area may be positioned in one or both of the two track belts 5*a* and 5*b*.

When the work machine does not have the upper swing body 3, the lifting of the working unit 2 represents operation of moving the working unit 2 in a direction away from the contact area of the work machine. The lowering of the working unit 2 represents operation of moving the working unit 2 in a direction approaching the contact area of the work machine. When the work machine includes wheels instead of the track belts, the contact area is a plane defined by at least three portions of a wheel making contact with the ground.

The working implement may not have the plurality of teeth 8BD. That is, the working implement may have a bucket not having the teeth 8BD as illustrated in FIG. 1, but having an edge made of a steel plate into a straight shape. The working unit 2 may include, for example, a tilt bucket having a single tooth. The tilt bucket includes a bucket tilt cylinder, and the bucket tilts right and left. Thus, even if the excavator is on an inclined ground, the bucket allows shaping and leveling of a slope or a flat ground into a desired shape. In addition, the working unit 2 may include a slope finishing bucket as the working implement, instead of the bucket 8.

The boom cylinder 10, the arm cylinder 11, and the bucket cylinder 12 illustrated in FIG. 1 are each a hydraulic cylinder driven by hydraulic fluid pressure (hereinafter, appropriately referred to as hydraulic pressure). The boom cylinder 10 drives the boom 6 so that the boom 6 is lifted and lowered. The arm cylinder 11 drives the arm 7 so that the arm 7 is operated around the arm pin 14. The bucket cylinder 12 drives the bucket 8 so that the bucket 8 is operated around the bucket pin 15.

A directional control valve 64 illustrated in FIG. 2 is provided between the hydraulic cylinders such as the boom cylinder 10, the arm cylinder 11, and the bucket cylinder 12, and hydraulic pumps 36 and 37 illustrated in FIG. 2. The directional control valve 64 controls a flow rate of hydraulic fluid supplied from the hydraulic pumps 36 and 37 to the boom cylinder 10, the arm cylinder 11, the bucket cylinder 12, or the like, and switches a flow direction of the hydraulic fluid.

A working unit controller 26 illustrated in FIG. 2 controls a control valve 27 illustrated in FIG. 2 to control a pilot pressure of hydraulic fluid supplied from an operation device 25 to the directional control valve 64. The control valve 27 is provided for a hydraulic system of the boom cylinder 10, the arm cylinder 11, and the bucket cylinder 12. The working unit controller 26 controls the control valve 27 provided in a pilot oil passage 450 to control operation of the boom cylinder 10, the arm cylinder 11, and the bucket cylinder 12. In the embodiment, the working unit controller 26 controls closing of the control valve 27 to control the boom cylinder 10, the arm cylinder 11, and the bucket cylinder 12 to have a reduced speed.

The upper swing body 3 has an upper portion to which antennas 21 and 22 are mounted. The antennas 21 and 22 are used to detect a current position of the excavator 100. The antennas 21 and 22 are electrically connected to a position detection device 19 illustrated in FIG. 2. The position detection device 19 is a position detection unit for detecting the current position of the excavator 100.

The position detection device 19 uses real time kinematic-global navigation satellite systems (RTK-GNSS, GNSS represents global navigation satellite system) to detect the current position of the excavator 100. In the following description, the antennas 21 and 22 are appropriately referred to as GNSS antennas 21 and 22. The position detection device 19 receives a signal according to a GNSS radio wave received by the GNSS antennas 21 and 22. The position detection device 19 detects mounting positions of the GNSS antennas 21 and 22. The position detection device 19 includes, for example, a three-dimensional position sensor.

<Hydraulic System 300>

As illustrated in FIG. 2, the hydraulic system 300 of the excavator 100 includes an internal combustion engine 35 as a power generation source, and the hydraulic pumps 36 and 37. The hydraulic pumps 36 and 37 are driven by the internal combustion engine 35 and eject the hydraulic fluid. The hydraulic fluid ejected from the hydraulic pumps 36 and 37 is supplied to the boom cylinder 10, the arm cylinder 11, and the bucket cylinder 12.

The excavator 100 includes a swing motor 38. The swing motor 38 is a hydraulic motor, and is driven by the hydraulic fluid ejected from the hydraulic pumps 36 and 37. The swing motor 38 swings the upper swing body 3. Note that, in FIG. 2, two hydraulic pumps 36 and 37 are illustrated, but only one hydraulic pump may be provided. The swing motor 38 is not limited to the hydraulic motor, and may employ an electric motor.

<Control System 200>

The control system 200 as a control system of the work machine includes the position detection device 19, a global coordinate calculation unit 23, the operation device 25, the working unit controller 26 as a control device for a work machine according to the embodiment, a sensor controller 39, a display controller 28, and a display unit 29. The operation device 25 is a device for operating the working unit 2 and the upper swing body 3 illustrated in FIG. 1. The operation device 25 is a device for operating the working unit 2. The operation device 25 receives operator's operation for driving the working unit 2, and outputs a pilot hydraulic pressure according to the amount of operator's operation.

The pilot hydraulic pressure according to the amount of operator's operation represents an operation command. The operation command is a command for operating the working unit 2. The operation command is generated by the operation device 25. Since the operation device 25 is operated by the operator, the operation command represents a command for operating the working unit 2 through manual operation, that is, operator's operation. Control of the working unit 2 through manual operation represents control of the working unit 2 based on the operation command from the operation device 25, that is, the working unit 2 is controlled by operating the operation device 25 of the working unit 2.

In the embodiment, the operation device 25 has a left operation lever 25L located on the left side of the operator, and a right operation lever 25R located on the right side of the operator. Front and back and right and left operation of the left operation lever 25L and the right operation lever 25R corresponds to two axis operation of the arm 7 and swing. For example, the front and back operation of the right operation lever 25R corresponds to operation of the boom 6. When the right operation lever 25R is operated forward, the boom 6 is lowered, and when the right operation lever 25R is operated backward, the boom 6 is lifted. Lowering and lifting operation of the boom 6 is performed according to the front and back operation. The right and left operation of the right operation lever 25R corresponds to operation of the bucket 8. When the right operation lever 25R is operated leftward, the bucket 8 performs excavation, and when the right operation lever 25R is operated rightward, the bucket 8 performs dumping. The excavation or opening movement of the bucket 8 is performed according to the right and left operation. Front and back operation of the left operation lever 25L corresponds to swing of the arm 7. When the left operation lever 25L is operated forward, the arm 7 performs dumping, and when the left operation lever 25L is operated backward, the arm 7 performs excavation. Right and left operation of the left operation lever 25L corresponds to swing of the upper swing body 3. When the left operation lever 25L is operated leftward, the upper swing body 3 swings leftward, and when the left operation lever 25L is operated rightward, the upper swing body 3 swings rightward.

In the embodiment, the operation device 25 is actuated by pilot hydraulic pressure. The hydraulic fluid is depressurized to a predetermined pilot pressure by a pressure reducing valve 25V, and supplied from the hydraulic pump 36 to the operation device 25, based on operation of the boom, the bucket, the arm, or swing.

In the embodiment, the left operation lever 25L and the right operation lever 25R of the operation device 25 are actuated by the pilot hydraulic pressure, but may be electrically actuated. When the left operation lever 25L and the right operation lever 25R are electrically actuated, an operation amount of each operation lever is detected by a potentiometer. The operation amounts of the left operation lever 25L and the right operation lever 25R detected by the potentiometers are obtained by the working unit controller 26. The working unit controller 26 detecting an operation signal from an operation lever electrically actuated performs control similar to control by an operation lever actuated by the pilot hydraulic pressure.

Pilot hydraulic pressure is supplied to the pilot oil passage 450 according to the front and back operation of the right operation lever 25R, and operator's operation of the boom 6 is received. A valve device of the right operation lever 25R is opened according to the operation amount of the right operation lever 25R, and hydraulic fluid is supplied to the pilot oil passage 450. Moreover, a pressure sensor 66 detects, as a pilot pressure, a hydraulic fluid pressure in the pilot oil passage 450 at that time. The pressure sensor 66 transmits the detected pilot pressure as a boom operation amount MB to the working unit controller 26. Hereinafter, the amount of front and back operation of the right operation lever 25R is appropriately referred to as a boom operation amount MB. A pilot oil passage 50 is provided with a control valve (hereinafter, appropriately referred to as intervention valve) 27C and a shuttle valve 51.

Pilot hydraulic pressure is supplied to the pilot oil passage 450 according to the right and left operation of the right operation lever 25R, and operator's operation of the bucket 8 is received. The valve device of the right operation lever 25R is opened according to the operation amount of the right operation lever 25R, and hydraulic fluid is supplied to the pilot oil passage 450. The pressure sensor 66 detects, as a pilot pressure, a hydraulic fluid pressure in the pilot oil passage 450 at that time. The pressure sensor 66 transmits the detected pilot pressure as a bucket operation amount MT to the working unit controller 26. Hereinafter, the amount of right and left operation of the right operation lever 25R is appropriately referred to as a bucket operation amount MT.

Pilot hydraulic pressure is supplied to the pilot oil passage 450 according to the front and back operation of the left operation lever 25L, and operator's operation of the arm 7 is received. A valve device of the left operation lever 25L is opened according to an operation amount of the left operation lever 25L, and hydraulic fluid is supplied to the pilot oil passage 450. The pressure sensor 66 detects, as a pilot pressure, a hydraulic fluid pressure in the pilot oil passage 450 at that time. The pressure sensor 66 transmits the detected pilot pressure as an arm operation amount MA to the working unit controller 26. Hereinafter, the amount of front and back operation of the left operation lever 25L is appropriately referred to as an arm operation amount MA.

Operation of the right operation lever 25R causes the operation device 25 to supply pilot hydraulic pressure having a magnitude according to the operation amount of the right operation lever 25R, to the directional control valve 64. Operation of the left operation lever 25L causes the operation device 25 to supply pilot hydraulic pressure having a magnitude according to the operation amount of the left operation lever 25L, to the directional control valve 64. The pilot hydraulic pressure supplied from the operation device 25 to the directional control valve 64 operates the directional control valve 64.

The control system 200 has a first stroke sensor 16, a second stroke sensor 17, and a third stroke sensor 18. For example, the first stroke sensor 16 is provided at the boom cylinder 10, the second stroke sensor 17 is provided at the arm cylinder 11, and the third stroke sensor 18 is provided at the bucket cylinder 12.

The sensor controller 39 has a processing unit such as a central processing unit (CPU), and a storage unit such as a random access memory (RAM) and a read only memory (ROM). The sensor controller 39 calculates a tilt angle θ1 of the boom 6 in a direction orthogonal to a horizontal plane in a local coordinate system of the excavator 100, in particular, a local coordinate system of the vehicle body 1, based on a length of the boom cylinder detected by the first stroke sensor 16, and outputs the calculated tilt angle θ1 to the working unit controller 26 and the display controller 28. The sensor controller 39 calculates a tilt angle θ2 of the arm 7 to the boom 6, based on a length of the arm cylinder detected by the second stroke sensor 17, and outputs the calculated tilt angle θ2 to the working unit controller 26 and the display controller 28. The sensor controller 39 calculates a tilt angle θ3 of a tooth tip 8T of the bucket 8 to the arm 7, based on a length of the bucket cylinder detected by the third stroke sensor 18, and outputs the calculated tilt angle θ3 to the working unit controller 26 and the display controller 28. The tilt angles θ1, θ2, and θ3 can be detected by a sensor other than the first stroke sensor 16, the second stroke sensor 17, and the third stroke sensor 18. For example, an angle sensor such as a potentiometer can detect the tilt angles θ1, θ2, and θ3.

To the sensor controller 39, an inertial measurement unit (IMU) 24 is connected. The IMU 24 obtains tilt information of a vehicle body such as pitch and roll of the excavator 100 illustrated in FIG. 1, and outputs the obtained tilt information to the sensor controller 39.

The working unit controller 26 has a processing unit 26P such as a CPU, and a storage unit 26M such as a RAM and a read only memory (ROM). The working unit controller 26 controls the intervention valve 27C and the control valve 27, based on the boom operation amount MB, the bucket operation amount MT, and the arm operation amount MA illustrated in FIG. 2.

The directional control valve 64 illustrated in FIG. 2 is, for example, a proportional control valve, and is controlled by hydraulic fluid supplied from the operation device 25. The directional control valve 64 is disposed between a hydraulic actuator, such as the boom cylinder 10, the arm cylinder 11, the bucket cylinder 12, and the swing motor 38, and the hydraulic pumps 36 and 37. The directional control valve 64 controls the flow rate and direction of the hydraulic fluid supplied from the hydraulic pumps 36 and 37 to the boom cylinder 10, the arm cylinder 11, the bucket cylinder 12, and the swing motor 38.

The position detection device 19 of the control system 200 includes the GNSS antennas 21 and 22 described above. The signal according to the GNSS radio wave received by the GNSS antennas 21 and 22 is input to the global coordinate calculation unit 23. The GNSS antenna 21 receives reference position data P1 indicating its own position, from a positioning satellite. The GNSS antenna 22 receives reference position data P2 indicating its own position, from a positioning satellite. The GNSS antennas 21 and 22 receive the reference position data P1 and P2 at predetermined intervals. The reference position data P1 and P2 represent information about mounting positions of the GNSS antennas. The GNSS antennas 21 and 22 output the reference position data P1 and P2 to the global coordinate calculation unit 23, whenever receiving the reference position data P1 and P2.

The global coordinate calculation unit 23 has a processing unit such as a CPU and a storage unit such as a RAM and a ROM. The global coordinate calculation unit 23 generates swing body location data indicating location of the upper swing body 3, based on the two sets of reference position data P1 and P2. In the present embodiment, the swing body location data includes reference position data P being one of the two sets of reference position data P1 and P2, and swing body orientation data Q generated based on the two sets of reference position data P1 and P2. The swing body orientation data Q represents an orientation of the upper swing body 3, that is, the working unit 2. The global coordinate calculation unit 23 updates the swing body location data, that is, the reference position data P and the swing body orientation data Q, and outputs the swing body location data to the display controller 28, whenever obtaining the two sets of reference position data P1 and P2 from the GNSS antennas 21 and 22 at predetermined intervals.

The display controller 28 has a processing unit such as a CPU and a storage unit such as a RAM and a ROM. The display controller 28 obtains the reference position data P and the swing body orientation data Q being the swing body location data from the global coordinate calculation unit 23. In the embodiment, the display controller 28 generates, as working unit position data, bucket tooth tip position data S representing a three-dimensional position of the tooth tip 8T of the bucket 8. Then, the display controller 28 uses the bucket tooth tip position data S and target excavation information T to generate target excavation profile data U.

The target excavation information T is information representing target finishing of the object to be excavated by the working unit 2 of the excavator 100 (hereinafter, appropriately referred to as object to be excavated). The target excavation information T includes, for example, design information of the object to be excavated by the excavator 100. The object excavated by the working unit 2 is, for example, the ground. Operation performed on the object to be excavated by the working unit 2 includes, for example, excavation operation and ground leveling operation, but is not limited to these operation.

The display controller 28 derives target excavation profile data Ua to be displayed based on the target excavation profile data U, and causes the display unit 29 to display the target profile of the object to be excavated by the working unit 2, for example, a ground profile, based on the target excavation profile data Ua to be displayed.

The display unit 29 is, for example, a liquid crystal display device receiving input from a touch panel, but is not limited to the liquid crystal display device. In the embodiment, a switch 29S is mounted adjacent to the display unit 29. The switch 29S is an input device for performance of below-mentioned intervention control or stopping the intervention control being performed.

The working unit controller 26 obtains the boom operation amount MB, the bucket operation amount MT, and the arm operation amount MA from the pressure sensor 66. The working unit controller 26 obtains the tilt angle θ1 of the boom 6, the tilt angle θ2 of the arm 7, and the tilt angle θ3 of the bucket 8 from the sensor controller 39.

The working unit controller 26 obtains the target excavation profile data U from the display controller 28. The target excavation profile data U is information included in the target excavation information T, representing a range of operation to be performed by the excavator 100. That is, the target excavation profile data U is part of the target excavation information T. Thus, the target excavation profile data U represents the target profile for finishing the object to be excavated by the working unit 2, similarly to the target excavation information T. Hereinafter, the target profile for finishing is appropriately referred to as target excavation profile.

The working unit controller 26 calculates the position of a tooth tip 8T of the bucket 8 (hereinafter, appropriately referred to as tooth tip position) based on the attitude and size of the working unit 2 obtained from the sensor controller 39. The working unit controller 26 controls the operation of the working unit 2 based on the distance between the target excavation profile data U and the tooth tip 8T of the bucket 8 and the speed of the working unit 2 so that the tooth tip 8T of the bucket 8 move according to the target excavation profile data U. In this configuration, the working unit controller 26 controls the working unit 2 to have a speed not more than a speed limit in a direction approaching the object to be excavated to inhibit the bucket 8 from crossing a predetermined target profile. This control is appropriately referred to as the intervention control. The target profile in the intervention control includes, for example, the target excavation profile data U, that is, the target excavation profile being a target profile of the object to be excavated by the working unit 2, and a ground profile separated from the target excavation profile by a predetermined distance.

The intervention control is performed, for example, when the operator of the excavator 100 selects performance of the intervention control using the switch 29S illustrated in FIG. 2. That is, the intervention control represents control for operating the working unit by the working unit controller 26 upon operation of the working unit 2 based on operation of the operation device 25, that is, operator's operation. When the working unit controller 26 calculates the distance between the target excavation profile and the bucket 8, a reference position of the bucket 8 is not limited to the tooth tip 8T and may be defined at an arbitrary portion.

In the intervention control, in order to control the working unit 2 so that the bucket 8 is operated according to the target excavation profile data U, the working unit controller 26 generates a boom command signal CBI and outputs the boom command signal CBI to the intervention valve 27C illustrated in FIG. 2 The boom 6 is operated according to the boom command signal CBI, and thus, a speed of the working unit 2, in particular, the bucket 8 accessing the target excavation profile data U is limited according to the distance between the bucket 8 and the target excavation profile data U.

In the intervention control, the working unit controller 26 controls the speed of the boom 6 based on the target excavation profile data U representing a designed ground profile being the target profile of the object to be excavated and the tilt angles θ1, θ2, and θ3 for determining the position of the bucket 8. The speed of the boom 6 is controlled so that the speed of the bucket 8 approaching the target excavation profile is reduced according to the distance between the target excavation profile and the bucket 8.

In the embodiment, when the working unit 2 is operated based on operator's operation of the operation device 25, the working unit controller 26 generates the boom command signal CBI to control the operation of the boom 6 using the boom command signal CBI so that the tooth tip 8T of the bucket 8 does not cross the target excavation profile. Specifically, the working unit controller 26 lifts the boom 6 to prevent the tooth tip 8T of the bucket 8 from crossing the target excavation profile, in the intervention control. The control for lifting the boom 6 performed in the intervention control is appropriately referred to as boom intervention control.

In the present embodiment, for achievement of the boom intervention control performed by the working unit controller 26, the working unit controller 26 generates the boom command signal CBI relating to the boom intervention control, and outputs the boom command signal CBI to the intervention valve 27C. The intervention valve 27C adjusts the pilot hydraulic pressure in the pilot oil passage 50.

The boom intervention control is control for lifting the boom 6 in the intervention control, but in the intervention control, the working unit controller 26 may lift at least one of the arm 7 and the bucket 8, in addition to or instead of lifting the boom 6. That is, in the intervention control, the working unit controller 26 lifts at least one of the boom 6, the arm 7, and the bucket 8 constituting the working unit 2 to move the working unit 2 in a direction away from the target profile, the target excavation profile 43I in this embodiment, of the object to be excavated by the working unit 2. The boom intervention control is a mode of the intervention control.

<Detailed Description of Working Unit Controller 26>

Figure 3:
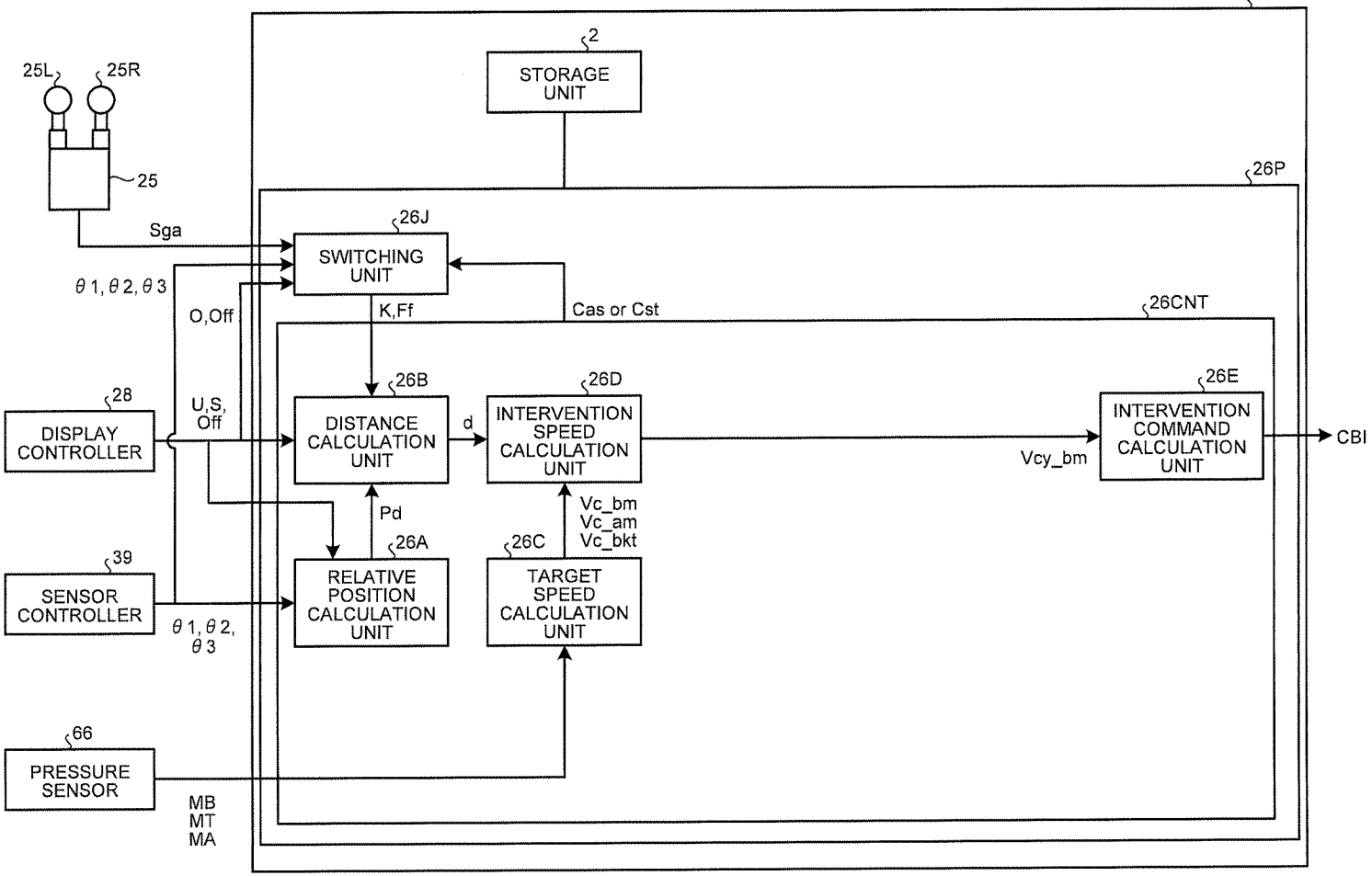
FIG. 3 is a block diagram of a working unit controller.
Figure 4:
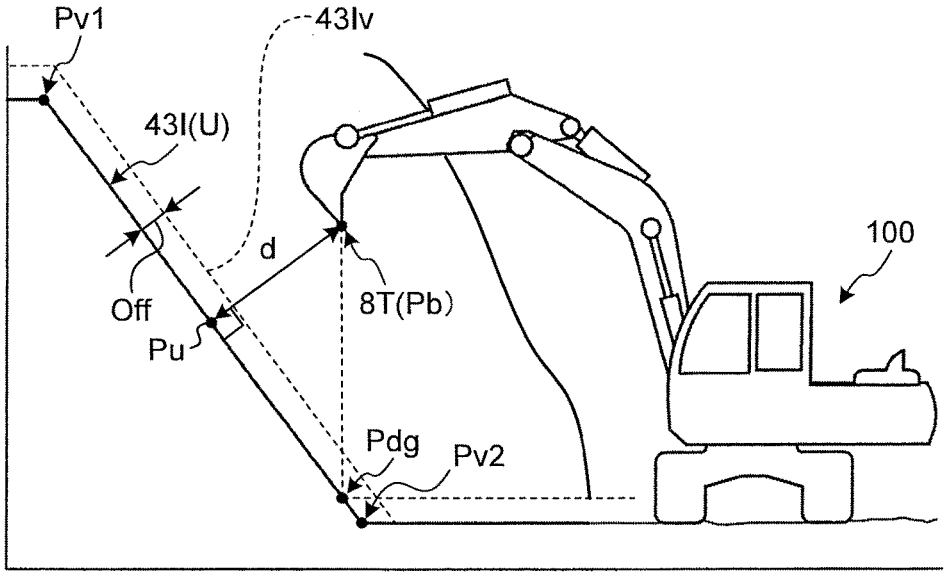
FIG. 4 is a diagram illustrating a target excavation profile 43I and a bucket 8.
Figure 5:
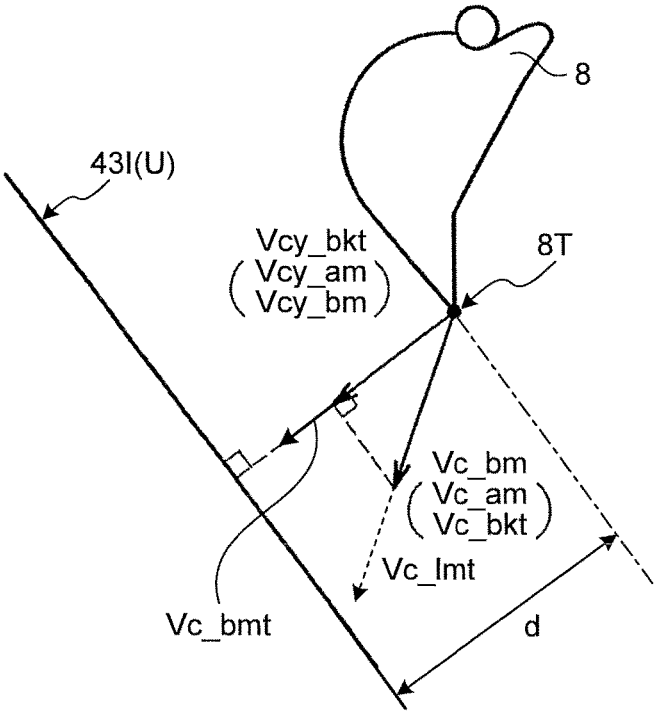
FIG. 5 is a diagram illustrating a boom speed limit.

FIG. 3 is a block diagram of the working unit controller 26. FIG. 4 is a diagram illustrating the target excavation profile 43I and the bucket 8. FIG. 5 is a diagram illustrating a boom speed limit Vcy_bm. The working unit controller 26 includes a control unit 26CNT and a switching unit 26J. The control unit 26CNT and the switching unit 26J are included in the processing unit 26P of the working unit controller 26. The processing unit 26P achieves the functions of the control unit 26CNT and the switching unit 26J.

The processing unit 26P of the working unit controller 26 executes a computer program for controlling the working unit 2 to control the working unit 2. The control of the working unit 2 includes the intervention control and control by a method of controlling a work machine according to an embodiment. The storage unit 26M stores a computer program for controlling the working unit 2.

The control unit 26CNT includes a relative position calculation unit 26A, a distance calculation unit 26B, a target speed calculation unit 26C, an intervention speed calculation unit 26D, an intervention command calculation unit 26E, and an intervention speed correction unit 26F. The control unit 26CNT performs the intervention control. In the embodiment, the control unit 26CNT controls the working unit 2 to prevent the bucket 8 from crossing the target profile during the intervention control. In the embodiment, the target profile in the intervention control is the target excavation profile 43I illustrated in FIG. 5 or an offset profile 43Iv separated from the target excavation profile 43I by a predetermined distance Off.

For performance of the intervention control, the working unit controller 26 uses the boom operation amount MB, the arm operation amount MA, the bucket operation amount MT, the target excavation profile data U obtained from the display controller 28, the tilt angles θ1, θ2, and θ3 obtained from the sensor controller 39, a shape of the bucket 8 to generate the boom command signal CBI required for the intervention control, generate an arm command signal and a bucket command signal if necessary, operate the control valve 27 and the intervention valve 27C, and control the working unit 2.

The relative position calculation unit 26A obtains the bucket tooth tip position data S from the display controller 28, and the tilt angles θ1, θ2, and θ3 from the sensor controller 39. The relative position calculation unit 26A determines the tooth tip position Pb being a position of the tooth tip 8T of the bucket 8, from the obtained tilt angles θ1, θ2, and θ3.

The distance calculation unit 26B calculates a shortest distance d between the tooth tip 8T of the bucket 8 and the target excavation profile 43I represented by the target excavation profile data U being part of the target excavation information T, based on the tooth tip position Pb determined by the relative position calculation unit 26A, and the target excavation profile data U obtained from the display controller 28. The distance d is a distance between the tooth tip position Pb and a position Pu at which a straight line orthogonal to the target excavation profile 43I and passing through the tooth tip position Pb crosses the target excavation profile data U.

When the target profile in the intervention control is the offset profile 43Iv, the distance calculation unit 26B obtains the distance Off from the display controller 28, adds the distance Off to a position of the target excavation profile 43I, and determines the offset profile 43Iv. The distance calculation unit 26B calculates the shortest distance d between the tooth tip 8T of the bucket 8 and the offset profile 43Iv. The distance Off is input by the operator of the excavator 100 from the touch panel of the display unit 29 illustrated in FIG. 2, and stored in the display controller 28.

The target excavation profile 43I can be determined from intersections between an operation plane of the working unit 2 and the target excavation information T represented by a plurality of target excavation planes. The operation plane of the working unit 2 is a plane defined in a front and back direction of the upper swing body 3, and passing through an excavation position Pdg, and on the plane, the working unit 2 is driven to move in the front and back direction of the upper swing body 3 to excavate the excavation position Pdg. More specifically, the intersections includes one or more inflection points in front and back of the excavation position Pdg of the target excavation information T and lines extending forward and backward from the inflection points. The one or more inflection points and the lines represent the target excavation profile 43I. In an example illustrated in FIG. 5, two inflection points Pv1 and Pv2 and the lines extending forward and backward from the inflection points represent the target excavation profile 43I. The excavation position Pdg is a point immediately below the position of the tooth tip 8T of the bucket 8, that is, the tooth tip position Pb. As described above, the target excavation profile 43I is part of the target excavation information T. The target excavation profile 43I is generated by the display controller 28 illustrated in FIG. 2.

The target speed calculation unit 26C determines a boom target speed Vc_bm, an arm target speed Vc_am, and a bucket target speed Vc_bkt. The boom target speed Vc_bm represents a speed of the tooth tip 8T upon driving the boom cylinder 10. The arm target speed Vc_am represents a speed of the tooth tip 8T upon driving the arm cylinder 11. The bucket target speed Vc_bkt represents a speed of the tooth tip 8T upon driving the bucket cylinder 12. The boom target speed Vc_bm is calculated according to the boom operation amount MB. The arm target speed Vc_am is calculated according to the arm operation amount MA. The bucket target speed Vc_bkt is calculated according to the bucket operation amount MT.

The intervention speed calculation unit 26D determines the boom speed limit Vcy_bm being the speed limit of the boom 6, based on the distance d between the tooth tip 8T of the bucket 8 and the target excavation profile 43I. The intervention speed calculation unit 26D subtracts the arm target speed Vc_am and the bucket target speed Vc_bkt from a speed limit Vc_lmt of the whole working unit 2 illustrated in FIG. 1, to determine the boom speed limit Vcy_bm. The speed limit Vc_lmt represents a permissible movement speed of the tooth tip 8T in a direction in which the tooth tip 8T of the bucket 8 approaches the target excavation profile 43I.

When the distance d has a positive value, the speed limit Vc_lmt has a negative value, that is, a lowering speed of the working unit 2 lowered is represented, and when the distance d has a negative value, the speed limit Vc_lmt has a positive value, that is, a lifting speed of the working unit 2 is represented. The negative value of the distance d represents a state in which the bucket 8 crosses the target excavation profile 43I. The speed limit Vc_lmt has an absolute value of the speed reduced as the distance d is reduced, and when the distance d has a negative value, the absolute value of the speed is increased as the absolute value of the distance d is increased.

The intervention command calculation unit 26E generates the boom command signal CBI, based on the boom speed limit Vcy_bm determined by the intervention speed correction unit 26F. The boom command signal CBI is a command for changing an opening of the intervention valve 27C to a size required for applying the pilot pressure to the shuttle valve 51. The pilot pressure is required for lifting the boom 6 at the boom speed limit Vcy_bm. In the embodiment, the boom command signal CBI is a current value according to a boom command speed.

The switching unit 26J defines the target profile in the intervention control as the offset profile 43Iv separated from the target excavation profile 43I by a predetermined distance Off or the target excavation profile 43I, based on an attitude of the bucket 8 relative to the target excavation profile 43I. In this configuration, the switching unit 26J obtains an arm operation command Sga from the operation device 25, the tilt angles θ1, θ2, and θ3 from the sensor controller, and an intervention control state Cas or a stop control state Cst from the control unit 26CNT, and gives an offset coefficient K and a fixing flag Ff to the distance calculation unit 26B.

The arm operation command Sga represents a signal showing whether the left operation lever 25L being a lever for operating the arm 7 is neutral in operation of the arm 7. When the left operation lever 25L is neutral in operation of the arm 7, the arm 7 is stopped. The intervention control state Cas represents performance of the intervention control, and the stop control state Cst represents performance of stop control. The stop control is one of the intervention control, and is control for stopping the working unit 2 when the bucket 8 crosses the target profile in the intervention control, that is, the target excavation profile 43I or the offset profile 43Iv. The stop control is configured to control the working unit 2 not to cross the target profile during the intervention control.

The offset coefficient K is a coefficient for switching a target ground profile in excavation control to the target excavation profile 43I or the offset profile 43Iv. The fixing flag Ff is a flag for causing the control unit 26CNT, in particular, the distance calculation unit 26B to maintain the target profile at the start of the excavation of the target profile, during a period from the start of excavation of the target profile by the working unit 2 to the end of a series of the excavation. When the fixing flag Ff is 1, the control unit 26CNT maintains the target profile at the start of the excavation of the target profile, during a period from the start of excavation of the target profile by the working unit 2 to the end of the series of the excavation.

For example, when the target profile at the start of the excavation of the target profile is the offset profile 43Iv, the control unit 26CNT maintains the target profile as the offset profile 43Iv, during a period from the start of excavation of the target profile by the working unit 2 to the end of the series of the excavation. When the target profile at the start of the excavation of the target profile is the target excavation profile 43I, the control unit 26CNT defines the target profile as the target excavation profile 43I, during a period from the start of excavation of the target profile by the working unit 2 to the end of the series of the excavation.

Figure 6:
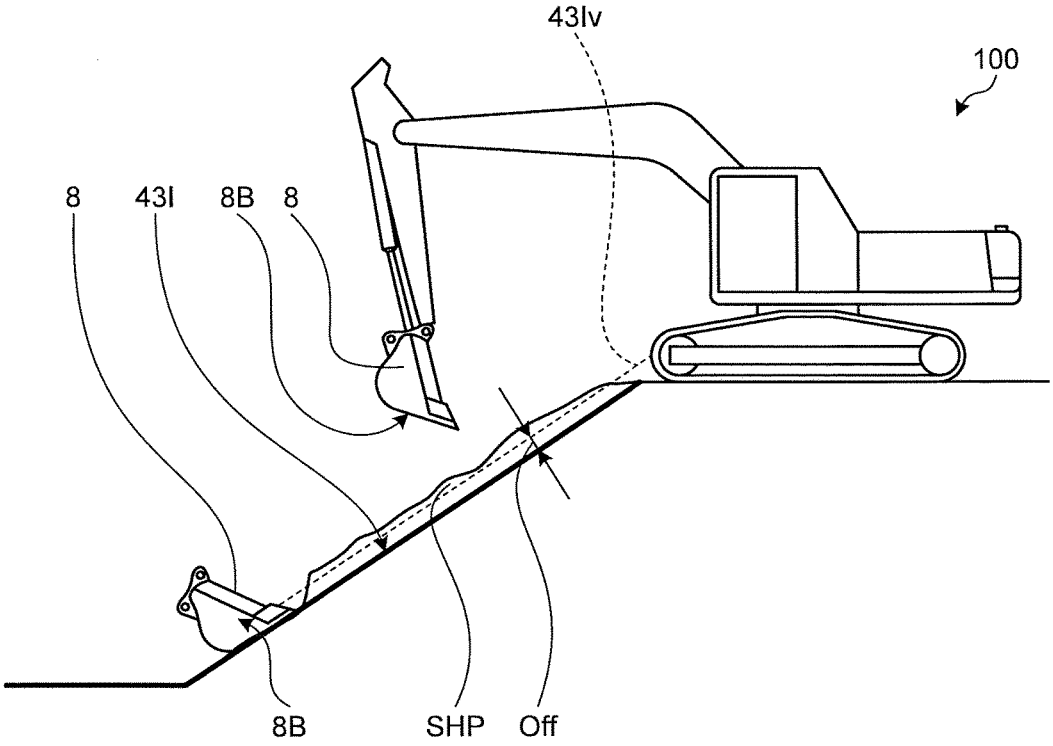
FIG. 6 is a diagram illustrating an example of excavation for forming a slope.
Figure 7:
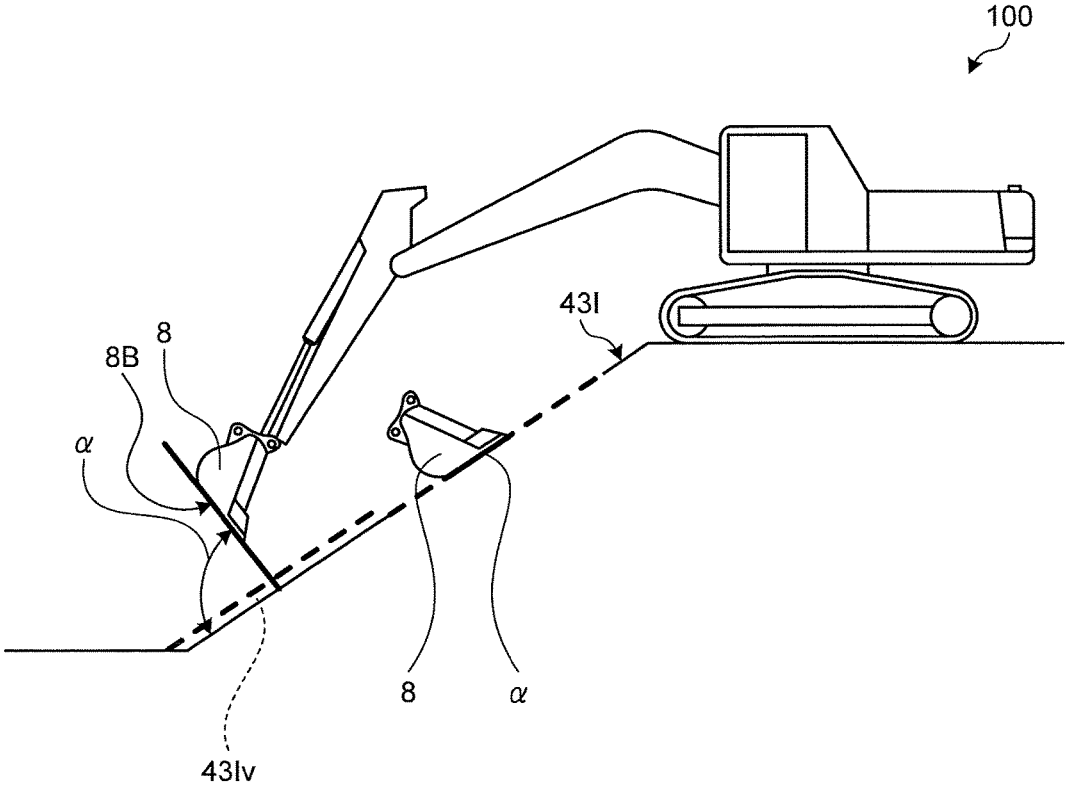
FIG. 7 is a diagram illustrating an example of excavation for forming a slope.

FIGS. 6 and 7 are diagrams illustrating examples of excavation for forming a slope. When the excavator 100 forms a slope, the excavator 100 excavates the object to be excavated, and then presses the object to be excavated up to the target excavation profile 43I with a bottom surface 8B of the bucket 8, and finishes the slope. The working unit controller 26 defines the target profile in the intervention control as the offset profile 43Iv, which is separated from the target excavation profile 43I by a predetermined distance Off (hereinafter, referred to as offset), and a compaction allowance can be secured to excavate the slope. In the embodiment, the operator can set the offset Off according to the operation of the excavator 100 from the touch panel of the display unit 29 illustrated in FIG. 2.

When the slope is formed in the object to be excavated, setting of the offset Off by the operator causes the working unit controller 26 to set the offset profile 43Iv as the target profile in the intervention control. When the bucket 8 excavates surface soil SHP of the object to be excavated, the working unit controller 26 performs the intervention control so that the bucket 8 may not cross the offset profile 43Iv. After the object to be excavated is excavated to the offset profile 43Iv, the operator cancels the offset Off. While the offset Off is cancelled, the excavator 100 presses the bottom surface 8B of the bucket 8 against the object to be excavated, and finishes the surface of the object to be excavated at the position of the target excavation profile 43I.

In finishing, the operator cancels the offset Off from the touch panel of the display unit 29 illustrated in FIG. 2. The working unit controller 26 defines the target profile in the intervention control as the target excavation profile 43I. When the bucket 8 is pressed against the object to be excavated, the working unit controller 26 controls the intervention control so that the bottom surface 8B of the bucket 8 may not cross the target excavation profile 43I. The surface soil SHP of an amount corresponding to the offset Off is pressed up to the target excavation profile 43I, in finishing, the surface of the object to be excavated is compacted, and the slope is completed.

When one slope is formed at a place, the excavator 100 similarly forms a slope at the next place. In this case, the operator sets the offset Off again. Further, when a slope is formed, the offset Off needs to be set again in the excavation and finish of the surface soil SHP. Thus, operator's operation is complicated to form a slope.

In order to inhibit complication of the operator's operation in forming a slope, the working unit controller 26 switches the target profile in the intervention control between the offset profile 43Iv and the target excavation profile 43I, based on the attitude of the bucket 8 relative to the target excavation profile 43I. Particularly, as illustrated in FIG. 7, the switching unit 26J of the working unit controller 26 switches the target profile in the intervention control, between the offset profile 43Iv and the target excavation profile 43I, for example, based on an angle α between the target excavation profile 43I and the bottom surface 8B of the bucket 8.

When the angle α has a large absolute value, the bucket 8 can be determined to excavate the object to be excavated. Further, when the angle α has a small absolute value, the bucket 8 can be determined to press the bottom surface 8B against the object to be excavated. For example, when the absolute value of the angle α is larger than an absolute value of a predetermined threshold ac, the switching unit 26J defines the target profile in the intervention control as the offset profile 43Iv. When the absolute value of the angle α is not larger than the absolute value of the predetermined threshold ac, the switching unit 26J defines the target profile in the intervention control as the target excavation profile 43I.

Owing to such processing, the target profile in the intervention control is automatically switched between excavation and finishing of the surface soil SHP. As a result, in forming a slope, the operator does not need to set the offset Off again in the excavation of the surface soil SHP and in the finishing of the object to be excavated, and the complication of the operator's operation is inhibited to form the slope.

Figure 8:
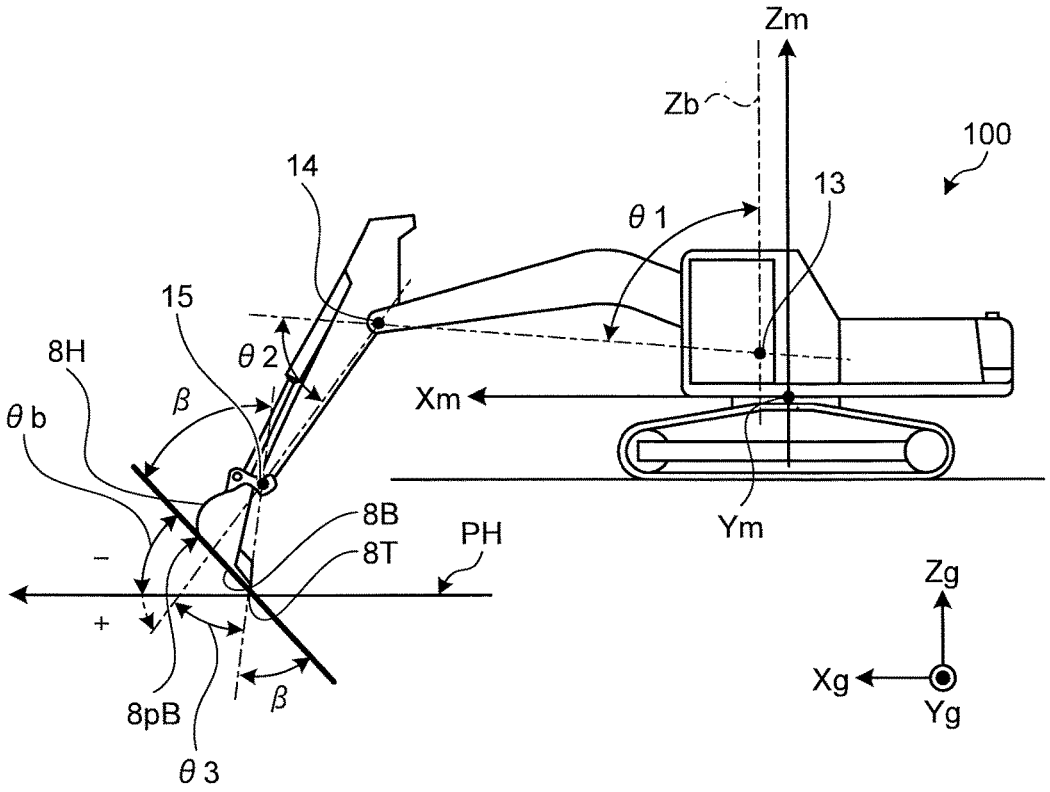
FIG. 8 is a diagram illustrating a method of determining an angle of a bottom surface of a bucket.

FIG. 8 is a diagram illustrating a method of determining an angle θb of the bottom surface 8B of the bucket 8. In the embodiment, as illustrated in FIG. 8, the angle (hereinafter, appropriately referred to as bottom surface angle) θb of the bottom surface 8B of the bucket 8 is parallel with an Xm-Ym plane in a vehicle body coordinate system, and a sign is – (negative) on the bucket 8 side, and +(positive) on the opposite side to the bucket 8, with reference to a plane PH making contact with the tooth tip 8T of the bucket 8. A horizontal plane is, for example, an Xg-Yg plane of a global coordinate system (Xg, Yg, Z,). The bottom surface angle θb is an angle between the bottom surface 8B of the bucket 8 and the plane PH. The bottom surface 8B of the bucket 8 is positioned between the tooth tip 8T of the bucket 8 and an end portion 8*p*B on the tooth tip 8T side of a backside 8H of the bucket 8. The backside 8H is an outer curved portion of the bucket 8. The angle θb can be calculated using formula (1).

$$\theta b = -270 + \theta 1 + \theta 2 + \theta 3 + \beta \quad (1)$$

The tilt angle of the boom 6 is denoted by θ1, the tilt angle of the arm 7 is denoted by θ2, the tilt angle of the bucket 8 is denoted by θ3, and an angle of the tooth tip 8T is denoted by β. The tilt angle θ1 is an angle between an axis Zb and an axis connecting an axis of the boom pin 13 and an axis of the arm pin 14. The axis Zb is a straight line orthogonal to a Zm axis of the vehicle body coordinate system (Xm, Ym, Zm) of the excavator 100, and passing through the axis of the boom pin 13. The tilt angle θ2 is an angle between a straight line connecting the axis of the boom pin 13 and the axis of the arm pin 14, and a straight line connecting the axis of the arm pin 14 and an axis of the bucket pin 15. The tilt angle θ3 is an angle between the straight line connecting the axis of the arm pin 14 and the axis of the bucket pin 15, and a straight line connecting the axis of the bucket pin 15 and the tooth tip of the bucket 8. The angle β of the tooth tip 8T is an angle between the line connecting the axis of the bucket pin 15 and the tooth tip of the bucket 8, and the bottom surface 8B of the bucket 8. The angle β of the tooth tip 8T is a value determined according to the type of the bucket 8, and is stored in the storage unit 26M of the working unit controller 26.

Figure 9:
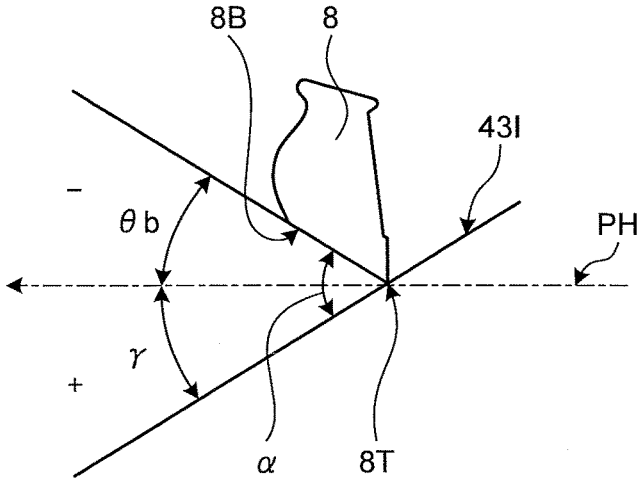
FIG. 9 is a diagram illustrating a method of determining an angle between a target excavation profile and a bottom surface of a bucket.

FIG. 9 is a diagram illustrating a method of determining the angle α between the target excavation profile 43I and the bottom surface 8B of the bucket 8. The angle α between the target excavation profile 43I and the bottom surface 8B of the bucket 8 can be calculated using formula (2). An angle γ is an angle of inclination of the target excavation profile 43I relative to the plane PH described above. The angle γ has a − (negative) sign in a direction turning toward the bottom surface 8B of the bucket 8 relative to the plane PH, and has a + (positive) sign in a direction turning away from the bottom surface 8B of the bucket 8 relative to the plane PH.

$$\alpha=\theta b-\gamma \quad (2)$$

Figure 10:
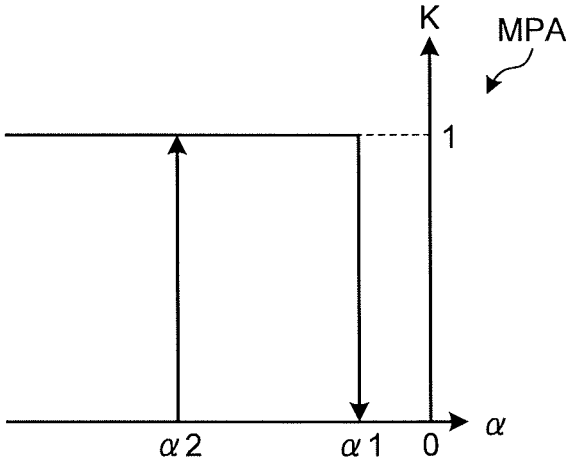
FIG. 10 is a graph illustrating a map including a threshold for switching an offset coefficient.
Figure 11:
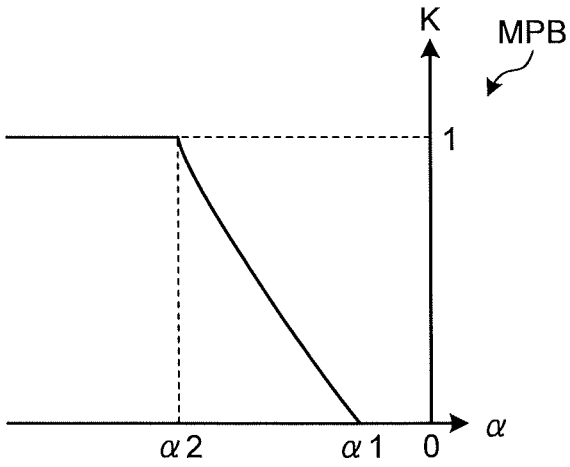
FIG. 11 is a graph illustrating a map including a threshold for switching the offset coefficient.

FIGS. 10 and 11 are graphs illustrating maps MPA and MPB including thresholds α1 and α2 for switching the offset coefficient K. In each of the map MPA and the map MPB, the vertical axis represents the offset coefficient K, and the horizontal axis represents the angle α. The angle α has a negative sign. The threshold α1 has an absolute value smaller than that of the threshold α2. In the map MPA, when the absolute value of the angle α is not more than the absolute value of the threshold α1, the offset coefficient K is changed from 1 to 0. When the absolute value of the angle α is larger than the absolute value of the threshold α1, and larger than the absolute value of the threshold α2, the offset coefficient K is changed from 0 to 1.

In the map MPB, when the absolute value of the angle α is not more than the absolute value of the threshold α2, the offset coefficient K is gradually reduced from 1 as the absolute value of the angle α is reduced. When the absolute value of the angle α is not more than the absolute value of the threshold α1, the offset coefficient K is 0.

The map MPA or the map MPB is stored in the storage unit 26M of the working unit controller 26 illustrated in FIG. 3. The switching unit 26J of the working unit controller 26 reads the map MPA or the map MPB from the storage unit 26M, after the angle α is determined, and obtains the offset coefficient K corresponding to the determined angle α, from the map MPA or the map MPB. The switching unit 26J gives the obtained offset coefficient K to the distance calculation unit 26B.

The distance calculation unit 26B multiplies the offset Off set by the operator by the offset coefficient K received from the switching unit 26J to obtain an offset Offc used for the intervention control. That is, the following formula is satisfied: Offc=K×Off. The distance calculation unit 26B adds the offset Offc to the position of the target excavation profile 43I to have the target profile in the intervention control. Now, the offset coefficient K determined by using the map MPA will be described. When the target profile in the intervention control is the offset profile 43Iv, since the offset coefficient K is 1, the target profile in the intervention control is the offset profile 43Iv. When the target profile in the intervention control is the target excavation profile 43I, since the offset coefficient K is 0, the target profile in the intervention control is the target excavation profile 43I.

The map MPA has hysteresis between changing the offset coefficient K from 1 to 0, that is, changing the offset profile 43Iv to the target excavation profile 43I, and changing the offset coefficient K from 0 to 1, that is, changing the target excavation profile 43I to the offset profile 43Iv. Such a configuration inhibits hunting caused by changing the offset coefficient K. Specifically, an event of lifting and dropping of the bucket 8, which is caused by changing the offset coefficient K, is inhibited. The map MPA may not have hysteresis in changing the offset coefficient K. That is, the offset coefficient K may be switched using the threshold αc alone.

When the offset coefficient K is determined from the map MPB, the offset coefficient K is changed between the thresholds α2 and α1 according to the size of the angle α. Thus, the target profile in the intervention control has a ground profile between the target excavation profile 43I and the offset profile 43Iv.

Figure 12:
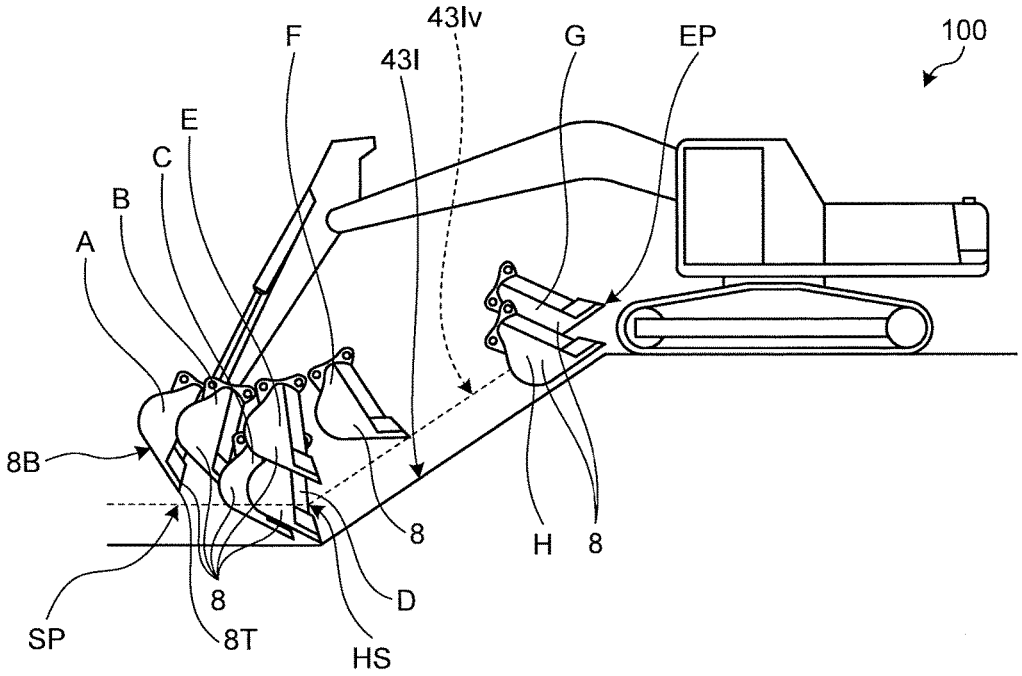
FIG. 12 is a diagram illustrating movement of the bucket, where a target profile in intervention control is an offset profile.

FIG. 12 is a diagram illustrating movement of the bucket, where the target profile in the intervention control is the offset profile 43Iv. When the bucket 8 excavates the surface soil SHP of the object to be excavated to form the slope, the target profile in the intervention control is the offset profile 43Iv. When the bucket 8 excavates the surface soil SHP, the attitude of the bucket 8 changes between a start position SP to an end position EP of the excavation. The offset profile 43Iv is positioned in a portion extending from the start position SP of the excavation to a lower end position HS on a lower end side of the slope, and a portion extending from the lower end position HS to the end position EP.

In this situation, the bucket 8 continuously excavates the object to be excavated from the start position SP to the end position EP through the lower end position HS. In the excavation, the operator's operation is mainly to operate the arm 7, and operation of the bucket 8 is rarely generated. Therefore, the bucket 8 approaches the lower end position HS, while gradually laying down the tooth tip 8T from the start position SP, that is, while reducing the absolute value of the angle α between the bottom surface 8B of the bucket 8 and the target excavation profile 43I (states A and B in FIG. 12). The target profile in the intervention control is the offset profile 43Iv.

When the absolute value of the angle α is not more than the threshold while the bucket 8 approaches the lower end position HS, the offset coefficient K is 0, and thus, the tooth tip 8T drops to the target excavation profile 43I, as illustrated in a state C of FIG. 12. When the tooth tip 8T of the bucket 8 is over the lower end position HS, and the target excavation profile 43I, which is immediately under the tooth tip 8T, changes to the slope, as illustrated in a state D of FIG. 12, the absolute value of the angle α increases above the absolute value of the threshold, and the offset coefficient K is 1. As a result, the tooth tip 8T is lifted to the offset profile 43Iv, as illustrated in a state E of FIG. 12.

As illustrated in a state F of FIG. 12, the bucket 8 excavates the slope not to cross the offset profile 43Iv. As illustrated in a state G of FIG. 12, when the tooth tip 8T passes a predetermined position of the slope while the bucket 8 is moved toward the end position EP, the absolute value of the angle α is reduced. When the absolute value of the angle α is not more than the absolute value of the threshold, the offset coefficient K is 0, and the tooth tip 8T drops to the target excavation profile 43I, as illustrated in a state H of FIG. 12.

As described above, while the bucket 8 is moved from the start position SP to the end position EP, the event of lifting and dropping of the bucket 8 may be generated. In order to avoid this event, the switching unit 26J causes the control unit 26CNT to maintain the target profile at the start of the excavation of the target profile, during a period from the start of excavation of the target profile in the intervention control by the working unit 2 to the end of the series of the excavation. For example, when the target profile in the intervention control is the offset profile 43Iv, the switching unit 26J sets the offset coefficient K to 1 and the fixing flag Ff to 1, and gives the offset coefficient K and the fixing flag Ff to the distance calculation unit 26B of the control unit 26CNT.

When receiving the fixing flag Ff=1, the distance calculation unit 26B maintains the offset coefficient K=1 until the fixing flag Ff is changed to 0. In the embodiment, when the left operation lever 25L is neutral in operation of the arm 7, that is, the arm is stopped and is not under stop control, the switching unit 26J sets the fixing flag Ff to 0. This state corresponds to movement of the bucket 8 until the end of a series of excavation of the slope, that is, from the start position SP to the end position EP.

Owing to such a configuration, before the end of the series of the excavation of the slope, the control unit 26CNT maintains the target profile in the intervention control at the offset profile 43Iv, during a period from the start of the excavation of the offset profile 43Iv as the target profile in the intervention control to the end of the series of the excavation. Thus, the event of lifting and dropping of the bucket 8 is avoided while the bucket 8 is moved from the start position SP to the end position EP.

When the target profile in the intervention control is the target excavation profile 43I, the switching unit 26J sets the offset coefficient K=0 and the fixing flag Ff=1, and gives the offset coefficient K=0 and the fixing flag Ff=1 to the distance calculation unit 26B of the control unit 26CNT. In this configuration, when receiving the fixing flag Ff=1, the distance calculation unit 26B maintains the offset coefficient K=1 until the fixing flag Ff is changed to 0. Owing to this processing, before the end of the series of the excavation of the slope, the control unit 26CNT maintains the target profile in the intervention control at the target excavation profile 43I, during a period from the start of the excavation of target excavation profile 43I as the target profile in the intervention control to the end of the series of the excavation. Thus, the event of lifting and dropping of the bucket 8 is avoided while the bucket 8 is moved from the start position SP to the end position EP.

<Method of Controlling Work Machine According to Embodiment>

Figure 13:
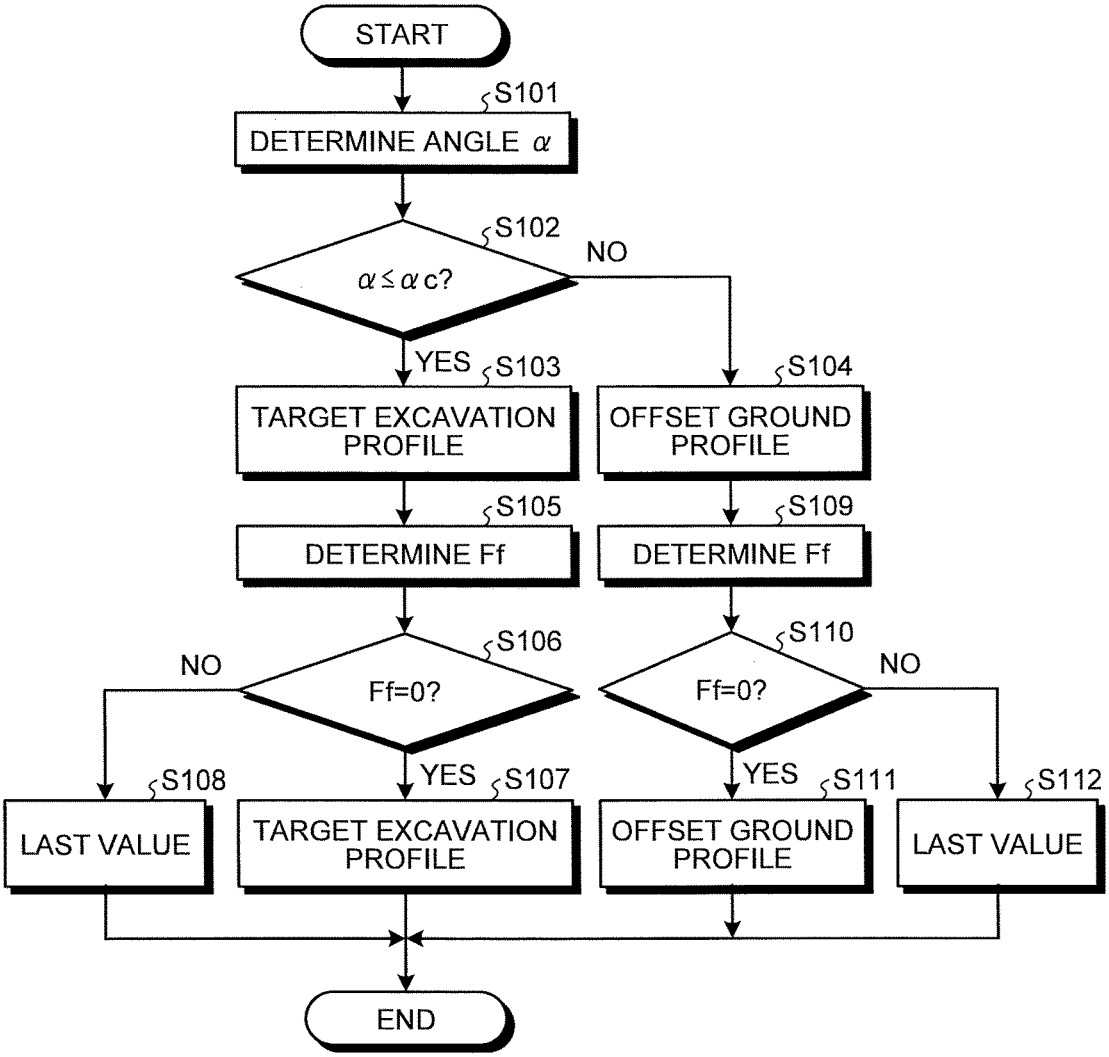
FIG. 13 is a flowchart illustrating a method of controlling a work machine according to an embodiment.

FIG. 13 is a flowchart illustrating an example of the method of controlling a work machine according to an embodiment. The method of controlling a work machine according to an embodiment is achieved by the working unit controller 26. Before starting excavation of a slope, the operator of the excavator 100 operates the switch 29S illustrated in FIG. 2 to input a command for performing the intervention control. Further the operator inputs the offset Off from the touch panel of the display unit 29 illustrated in FIG. 2. The offset Off may be previously stored in the storage unit 26M of the working unit controller 26, and read from the storage unit 26M by the operator's operation of the touch panel of the display unit 29. The intervention control is started by operating the arm 7, that is, by operating the left operation lever 25L in an operation direction of the arm 7.

In step S101, the working unit controller 26, in particular, the switching unit 26J determines the angle α. In this case, the switching unit 26J obtains the tilt angles θ1, θ2, and θ3 from the sensor controller 39, and the angle β of the tooth tip 8T from the storage unit 26M, and calculates the bottom surface angle θb using formula (1). Moreover, the switching unit 26J obtains the target excavation profile data U, from the display controller 28 to determine the target excavation profile 43I, and obtains the angle γ from the determined target excavation profile 43I. The switching unit 26J substitutes the angle γ and the bottom surface angle θb in the formula (2), and calculates the angle α.

In step S102, the switching unit 26J compares the angle α and the threshold ac determined in step S101. In the above-mentioned description, the switching unit 26J determines the offset coefficient K using the map MPA or the map MPB to determine the target ground profile in the intervention control, but here, description is made of an example of comparison between the angle α and the threshold ac for determination of the target ground profile in the intervention control, for convenience of description.

When the absolute value of the angle α determined in step S101 is not more than the absolute value of the threshold (step S102, Yes), the switching unit 26J defines the target ground profile in the intervention control as the target excavation profile 43I, in step S103. That is, the switching unit 26J sets the offset coefficient K to 0. When the absolute value of the angle α determined in step S101 is larger than the absolute value of the threshold (step S102, No), the switching unit 26J defines the target ground profile in the intervention control as the offset profile 43Iv, in step S104. That is, the switching unit 26J sets the offset coefficient K to 1.

In step S103, when the target ground profile in the intervention control is the target excavation profile 43I, the switching unit 26J determines the fixing flag Ff in step S105. In the embodiment, the fixing flag Ff is determined as described in the following (1) to (4). Here, the switching unit 26J obtains the arm operation command Sga from the operation device 25, and obtains the intervention control state Cas or the stop control state Cst from the control unit 26CNT.

(1) When the fixing flag Ff has a last value of 1, on condition that the left operation lever 25L is neutral in operation of the arm 7, and not under stop control, that is, not in the stop control state Cst, the switching unit 26J sets the fixing flag Ff to 0.

(2) When the fixing flag Ff has a last value of 1, on condition that the left operation lever 25L is not neutral in operation of the arm 7, or not under stop control, the switching unit 26J sets the fixing flag Ff to 1.

(3) When the fixing flag Ff has a last value of 0, on condition that the last control state is the intervention control, that is, the intervention control state Cas, the switching unit 26J sets the fixing flag Ff to 1.

(4) When the fixing flag Ff has a last value of 0, on condition that the last control state is not the intervention control, that is, not the intervention control state Cas, the switching unit 26J sets the fixing flag Ff to 0.

The switching unit 26J gives the offset coefficient K determined in step S103 and the fixing flag Ff determined in step S105 to the distance calculation unit 26B. When the fixing flag Ff is 0 (step S106, Yes), the current target ground profile is not maintained, and thus, the distance calculation unit 26B defines the target ground profile in the intervention control as the target excavation profile 43I according to the offset coefficient K determined in step S103, in step S107.

When the fixing flag Ff is 1 (step S106, No), the current target ground profile is maintained, and thus, the distance calculation unit 26B maintains the target ground profile in the intervention control at the last value, in step S108. When the last value is the offset profile 43Iv, the target ground profile in the intervention control is the offset profile 43Iv, and when the last value is the target excavation profile 43I, the target ground profile in the intervention control is the target excavation profile 43I.

In step S104, when the target ground profile in the intervention control is the offset profile 43Iv, the switching unit 26J determines the fixing flag Ff in step S109. Determination of the fixing flag Ff is performed as described above.

The switching unit 26J gives the offset coefficient K determined in step S104 and the fixing flag Ff determined in step S109 to the distance calculation unit 26B. When the fixing flag Ff is 0 (step S110, Yes), the current target ground profile is not maintained, and thus, the distance calculation unit 26B defines the target ground profile in the intervention control as the offset profile 43Iv according to the offset coefficient K determined in step S104, in step S111. When the fixing flag Ff is 1 (step S110, No), the current target ground profile is maintained, and thus, the distance calculation unit 26B maintains the target ground profile in the intervention control at the last value, in step S112.

In step S102, description has been made of comparison between the angle α and the threshold ac. Here, an example of determination of the target ground profile in the intervention control is described, in which the switching unit 26J uses the map MPA to determine the offset coefficient K. In step S102, the switching unit 26J reads the map MPA from the storage unit 26M, and determines the offset coefficient K corresponding to the angle α determined in step S101. Determination of the offset coefficient K using the map MPA is performed as described in the following (1) to (4).

(1) When the current target ground profile is the offset profile 43Iv, on condition that the absolute value of the angle α is not more than the absolute value of the threshold α1, a Yes result is obtained in step S102. In this configuration, the switching unit 26J sets the offset coefficient K to 0. That is, in step S103, the target ground profile is the target excavation profile 43I.

(2) When the current target ground profile is the offset profile 43Iv, on condition that the absolute value of the angle α is more than the absolute value of the threshold α2, a No result is obtained in step S102. In this configuration, the switching unit 26J sets the offset coefficient K to 1. That is, in step S104, the switching unit 26J defines the target ground profile as the offset profile 43Iv.

(3) When the current target ground profile is the target excavation profile 43I, on condition that the absolute value of the angle α is not more than the absolute value of the threshold α1, a Yes result is obtained in step S102. In this configuration, the switching unit 26J sets the offset coefficient K to 0. That is, in step S103, the target ground profile is the target excavation profile 43I.

(4) When the current target ground profile is the offset profile 43Iv, on condition that the absolute value of the angle α is more than the absolute value of the threshold α2, a No result is obtained in step S102. In this configuration, the switching unit 26J sets the offset coefficient K to 1. That is, in step S104, the target ground profile is the offset profile 43Iv.

<In Case of Target Excavation Profile 43I Positioned Above Current Ground Profile>

Figure 14:
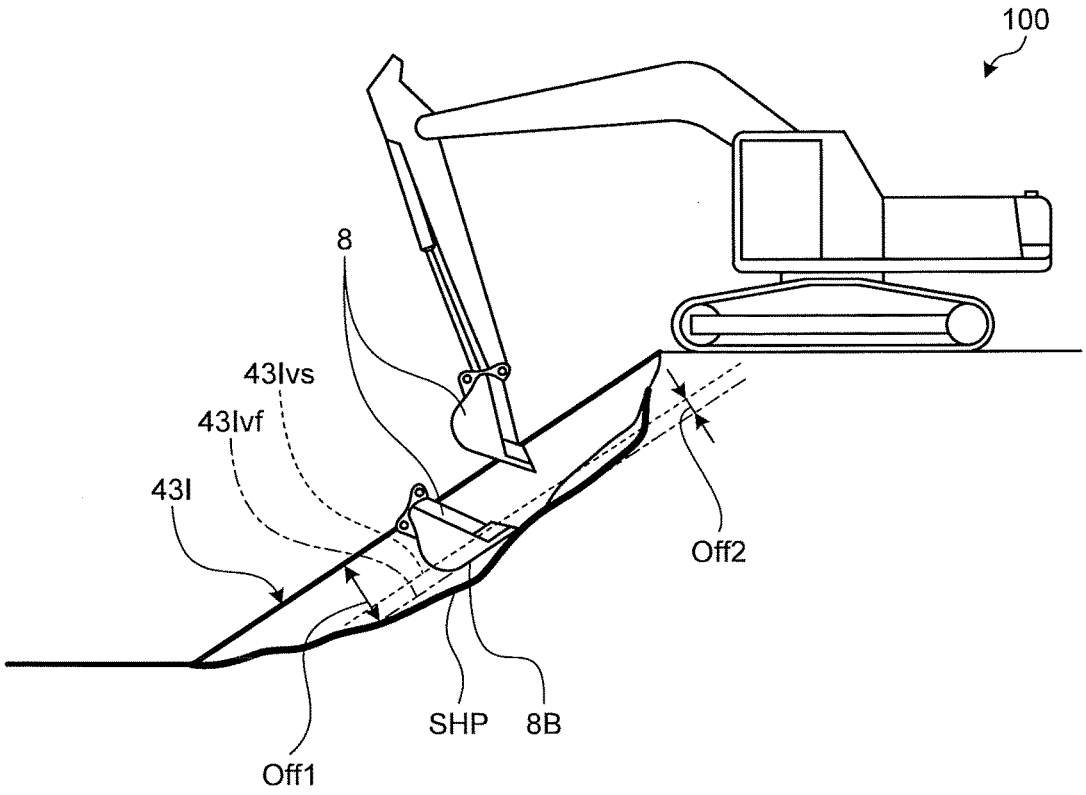
FIG. 14 is a diagram illustrating an example of excavation according to an embodiment, where a target excavation profile is positioned above a current ground profile.

FIG. 14 is a diagram illustrating an example of excavation according to an embodiment, where the target excavation profile 43I is positioned above the current ground profile. For example, when a slope is formed by fill, the target excavation profile 43I is positioned above the current ground profile. In this configuration, the excavator 100 fills the surface soil SHP of the object to be excavated, and then repeats filling and shaping up to the position of the target excavation profile 43I, while pressing the bottom surface 8B of the bucket 8 against the filled portion for shaping.

When the target excavation profile 43I is positioned above the current ground profile, an offset profile 43Ivf is positioned below the target excavation profile 43I. In this situation, the working unit controller 26, in particular, the switching unit 26J can define the target profile in the intervention control as an offset profile 43Ivs.

Moreover, when the offset profile 43Ivf is positioned under the target excavation profile 43I, the switching unit 26J may define the target profile in the intervention control as a ground profile separated from the offset profile 43Ivf toward the target excavation profile 43I by a predetermined distance Off2, based on the attitude of the bucket 8 relative to the target excavation profile 43I. In the embodiment, an offset profile 43IVf positioned under the target excavation profile 43I is appropriately referred to as first offset profile 43Ivf. A ground profile separated from the first offset profile 43Ivf toward the target excavation profile 43I by a predetermined distance Off2 is appropriately referred to as second offset profile 43Ivs.

The first offset profile 43Ivf is a ground profile separated below from the target excavation profile 43I by a distance Off1. The distance Off1 is set by the operator from the touch panel of the display unit 29 illustrated in FIG. 2. The distance Off2 for defining the second offset profile 43Ivs is set by the operator from the touch panel of the display unit 29 illustrated in FIG. 2. The second offset profile 43Ivf is multiplied by the offset coefficient K. When the offset coefficient K is 0, the target ground profile in the intervention control is the first offset profile 43Ivf. When the offset coefficient K is 1, the target ground profile in the intervention control is the second offset profile 43Ivs. Conditions of changing the offset coefficient K are the same as those described above.

When the absolute value of the angle α is larger than the threshold, the excavator 100 fills earth on the surface the object to be excavated with earth, levels the filled earth, or removes excessive earth. Thus, when the absolute value of the angle α is larger than the threshold, the switching unit 26J sets the offset coefficient K to 1 and defines the target ground profile in the intervention control as the second offset profile 43Ivf.

When the absolute value of the angle α is not more than the threshold, the excavator 100 presses the object to be excavated with the bottom surface 8B of the bucket 8, and compact the surface of the object to be excavated to the position of the first offset profile 43Ivf. Thus, when the absolute value of the angle α is not more than the threshold, the switching unit 26J sets the offset coefficient K to 0 and defines the target ground profile in the intervention control as the first offset profile 43Ivf.

As described above, in the embodiment, the target profile in the intervention control is defined as the offset profile 43I separated from the target excavation profile 43I by a predetermined distance Off or the target excavation profile 43I, based on the attitude of the bucket 8 relative to the target excavation profile. Such processing eliminates the need for setting the distance Off every time a slope or the like is excavated, after the distance Off is set once to set the offset profile 43Iv, by the operator of the excavator 100, and complicated operation of the operator is reduced in forming a slope or the like.

In the embodiment, the target profile at the start of the excavation of the target profile is maintained, during a period from the start of excavation of the target profile in the intervention control by the working unit 2 to the end of the series of the excavation. In the embodiment, owing to such operation, the lifting and dropping of the bucket 8 can be inhibited during excavation of a slope, rolling compaction operation provides a constant amount of rolling compaction, and an uneven slope can be reduced.

In the embodiment, when the arm 7 is stopped, and the stop control for stopping the working unit 2 is not performed in the intervention control, the maintained target profile at the start of the excavation is cancelled. Owing to Such processing, a target profile in the intervention control is set based on new attitude of the bucket 8, after a period from the start of excavation of the target profile in the intervention control by the working unit 2 to the end of the series of the excavation, and operation of the operator working unit can be achieved according to the intention of the operator.

In the embodiment, when the offset profile 43Ivf is positioned below the target excavation profile 43I, the target profile in the intervention control may be defined as the offset profile 43Ivf. Such processing simplifies the control.

In the embodiment, when the offset profile 43Ivf is positioned below the target excavation profile 43I, the target profile in the intervention control may be defined as the second offset profile 43Ivs separated from the first offset profile 43Ivf toward the target excavation profile 43I by a predetermined distance Off2, based on the attitude of the bucket 8 relative to the target excavation profile 43I. When earth filled on the surface of the object to be excavated is leveled or excessive filled earth is removed, such processing can inhibit the bucket 8 from crossing the first offset profile 43Ivf.

In embodiment, the working implement employs the bucket 8, but the working implement may employ a tilt bucket. In this configuration, for example, an angle between the target excavation profile 43I, and a bottom surface of a cross-section of the tilt bucket taken along a plane orthogonal to a width direction of the tilt bucket is defined as the angle $\alpha$ in the embodiment.

The embodiment has been made as described above, but the embodiment is not limited to the above-mentioned contents. Moreover, the above-mentioned components include a component conceived by those skilled in the art, a substantially identical component, and a so-called equivalent component. Moreover, the above-mentioned components can be appropriately combined with each other. Moreover, at least one of various omission, substitution, and alteration of the components may be made without departing from the spirit of the invention.

REFERENCE SIGNS LIST

1 VEHICLE BODY
2 WORKING UNIT
6 BOOM
7 ARM
8 BUCKET
8H BACKSIDE
8BD TOOTH
8T TOOTH TIP
8B BOTTOM SURFACE
13 BOOM PIN
14 ARM PIN
15 BUCKET PIN
16 FIRST STROKE SENSOR
17 SECOND STROKE SENSOR
18 THIRD STROKE SENSOR
25 OPERATION DEVICE
25L LEFT OPERATION LEVER
25R RIGHT OPERATION LEVER
26 WORKING UNIT CONTROLLER
26A RELATIVE POSITION CALCULATION UNIT
26B DISTANCE CALCULATION UNIT
26C TARGET SPEED CALCULATION UNIT
26CNT CONTROL UNIT
26D INTERVENTION SPEED CALCULATION UNIT
26E INTERVENTION COMMAND CALCULATION UNIT
26F INTERVENTION SPEED CORRECTION UNIT
26M STORAGE UNIT
26P PROCESSING UNIT
26J SWITCHING UNIT
27C INTERVENTION VALVE
28 DISPLAY CONTROLLER
29S SWITCH
39 SENSOR CONTROLLER
43I TARGET EXCAVATION PROFILE
43Iv OFFSET PROFILE
43Ivf FIRST OFFSET PROFILE (OFFSET PROFILE)
43Ivs SECOND OFFSET PROFILE (OFFSET PROFILE)
100 EXCAVATOR
Cas, Cst CONTROL STATE
CBI BOOM COMMAND SIGNAL
d DISTANCE
Ff FIXING FLAG
K OFFSET COEFFICIENT
MPA, MPB MAP
Off, Offc OFFSET
Sga ARM OPERATION COMMAND
$\alpha$c, $\alpha$1, $\alpha$2 THRESHOLD
$\theta$1, $\theta$2, $\theta$3 TILT ANGLE
$\theta$b BOTTOM SURFACE ANGLE

The invention claimed is:

1. A control device for a work machine, the control device being configured to control a working unit of the work machine to excavate an object to be excavated, the control device comprising:

a control unit configured to control the working unit to prevent a working implement of the working unit from crossing a predetermined target profile; and a switching unit configured to define the target profile as an offset profile separated by a predetermined distance from a target excavation profile that is a target profile for finishing of the object to be excavated or the target excavation profile, based on an attitude of the working implement relative to the target excavation profile.

2. The control device for a work machine according to claim 1, wherein the switching unit causes the control unit to maintain the target profile at a start of the excavation of the target profile, during a period from the start of the excavation of the target profile by the working unit to an end of a series of the excavation.

3. The control device for a work machine according to claim 2, wherein the working unit has an arm mounted to the working implement, the control unit performs control to stop the working unit, when the working implement crosses the target profile, and the switching unit cancels the maintained target profile, when the arm is stopped and controlling the working unit not to cross the target profile is not performed.

4. The control device for a work machine according to claim 1, wherein when the offset profile is positioned below the target excavation profile, the switching unit defines the target profile as the offset profile.

5. The control device for a work machine according to claim 1, wherein when the offset profile is positioned below the target excavation profile, the switching unit defines the target profile as a ground profile separated by a predetermined distance from the offset profile toward the target excavation profile that is a target profile for finishing of the object to be excavated, based on the attitude of the working implement relative to the target excavation profile.

6. A work machine comprising the control device for a work machine according to claim 1.

7. The control device for a work machine according to claim 1, wherein the switching unit defines the target profile as the offset profile when the attitude reflects an excavating operation, and defines the target profile as the target excavation profile when the attitude reflects a finishing operation.

8. The control device for a work machine according to claim 1, wherein the switching unit defines the target profile as the offset profile when the attitude is greater than a threshold, and defines the target profile as the target excavation profile when the attitude is less than a threshold.

9. The control device for a work machine according to claim 8, wherein the attitude comprises an angle between the target excavation profile and a bottom surface of the working implement.

10. A method of controlling a work machine, the method controlling a working unit of the work machine to excavate an object to be excavated, the method comprising:

defining a predetermined target profile as an offset profile separated by a predetermined distance from a target excavation profile that is a target profile for finishing of the object to be excavated or the target excavation profile, based on an attitude of the working implement relative to the target excavation profile; and controlling the working unit not to cross the target profile while the working unit excavates the object to be excavated.

* * * * *